United States Patent [19]

Smith et al.

[11] Patent Number: 4,484,523

[45] Date of Patent: Nov. 27, 1984

[54] DETONATOR, SOLID STATE TYPE I FILM BRIDGE

[75] Inventors: Rex L. Smith; D. Philip Ankeney; Patrick A. Yates; Henry F. Blazek; Steven E. Fowler, all of Ridgecrest, Calif.

[73] Assignee: The United States of America as represented by the Secretary of the Navy, Washington, D.C.

[21] Appl. No.: 479,424

[22] Filed: Mar. 28, 1983

[51] Int. Cl.[3] ..... F42C 19/12

[52] U.S. Cl. ..... 102/202.5; 102/202.4

[58] Field of Search ..... 102/202.5, 202.1, 202.3, 102/202.4

[56] References Cited

U.S. PATENT DOCUMENTS

| | | | |
|---|---|---|---|
| 3,018,732 | 1/1962 | Tognola | 102/70.2 |
| 3,198,117 | 8/1965 | Purdy et al. | 102/28 |
| 3,324,793 | 6/1967 | Thomas | 102/28 |
| 3,333,538 | 8/1967 | Schnettler | 102/28 |
| 3,344,744 | 10/1967 | Bankston, Jr. | 102/28 |
| 3,366,055 | 1/1968 | Hollander, Jr. | 102/28 |
| 3,744,416 | 7/1973 | Rudolph et al. | 102/28 M |
| 3,753,403 | 8/1973 | Menichelli | 102/28 R |
| 3,999,484 | 12/1976 | Evans | 102/28 R |
| 4,103,619 | 8/1978 | Fletcher et al. | 102/202.5 |
| 4,307,663 | 12/1981 | Stonestrom | 102/202.4 |
| 4,409,898 | 10/1983 | Blix et al. | 102/202.5 |

*Primary Examiner*—Charles T. Jordan

*Attorney, Agent, or Firm*—Robert F. Beers; W. Thom Skeer; Kenneth G. Pritchard

[57] ABSTRACT

A solid state detonator is made using a silicon chip with appropriate surrounding sections to provide the resistance path necessary to detonate a primary explosive. The chip is set on a metal-to-glass-to-metal header to provide uniformity of current and insulation capabilities. A gold mesh is used as a conductor connected to a chromium-silicon resistor film. This provides a uniform annular heating ring for detonation purposes. The silicon chip may be doped for high conductivity and low resistance. This arrangement provides fast function with moderate power pulses while the thermal design permits high no-fire current levels.

7 Claims, 1 Drawing Figure

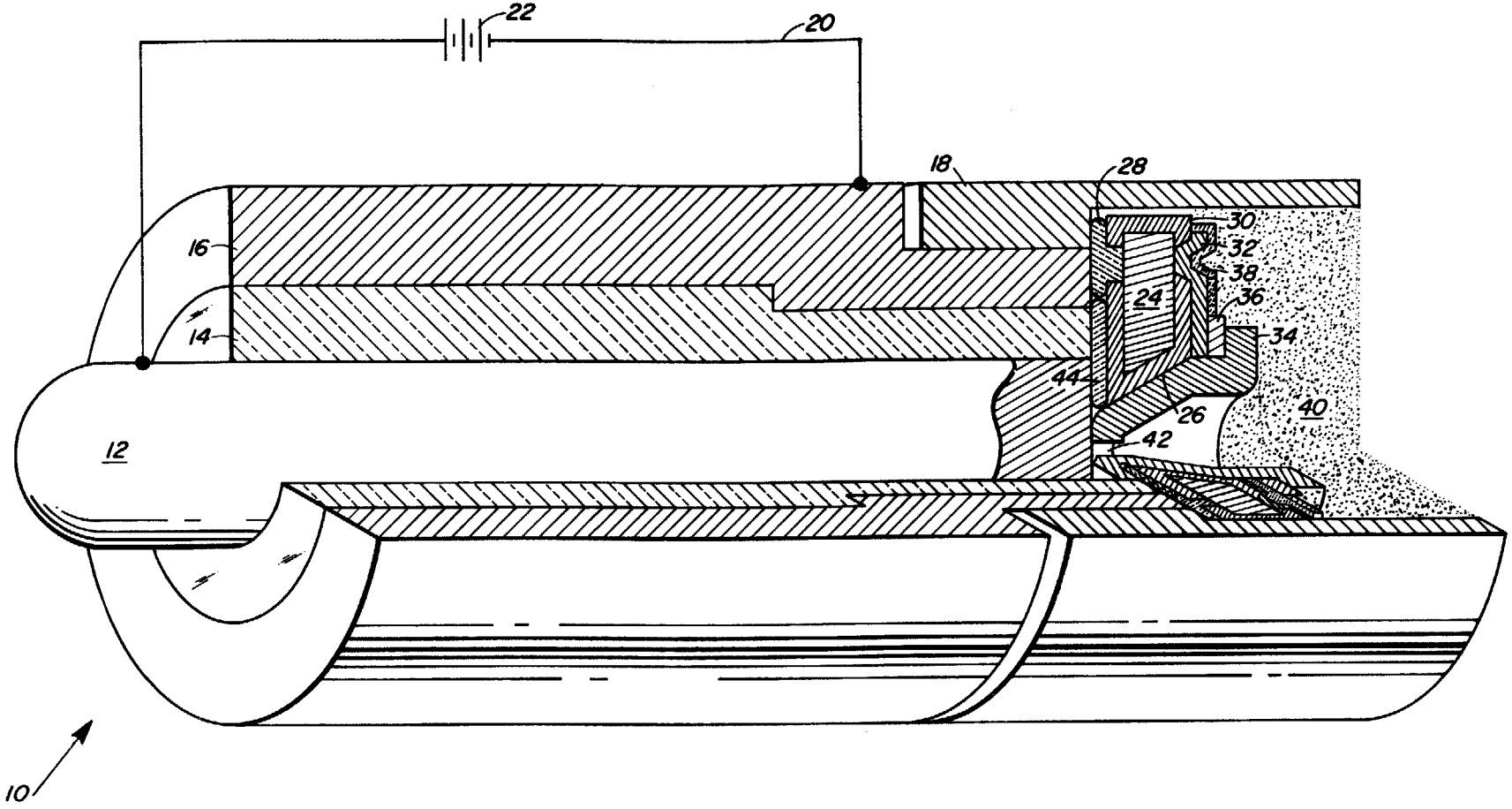
10
12
14
16
18
20
22
24
26
28
30
32
34
36
38
40
42
44

DETONATOR, SOLID STATE TYPE I FILM BRIDGE

BACKGROUND OF THE INVENTION

1. Field of the Invention

This invention is for electro-explosive devices. In particular, this invention is for electro-explosive devices with large area uniform detonation surfaces and high safety and reliability with fast response times.

2. Description of the Prior Art

Electro-explosive devices, EEDs, fall into one of two basic groups in current technology. The first group is electro-thermally initiated devices which respond to relatively low electrical energies. The second group is electro-shock initiated devices which include exploding wire and foil designs requiring very high energy levels.

The shock initiated devices have the advantages of very fast and repeatable function times and very high resistance to inadvertent initiation. The greatest disadvantage of the second group of EEDs is the large and expensive electrical systems required to initiate them. The electro-thermally initiated group, while operating at much lower input energy requirements, have not matched the inherent input safety characteristics or response time of the shock initiated group. Typical response times for the thermally initiated group range from about 10 microseconds to several milliseconds, while the shock initiated EEDs function in less than one microsecond.

In order to obtain environmental tolerance with long shelf-life for military and aerospace systems, both types are usually designed with hermetically sealed housings. These additional requirements plus those of ensuring adequate safety in handling and system assembly require that the thermally initiated group be able to withstand reasonable unintended currents without firing. This problem does not arise in the shock initiated EED group because the currents required for firing are typically several thousand amps. However, thermally initiated designs have problems with this respect since any current will produce some heating of the bridgewire and most designs have limited capability to conduct this heat away from the thermally sensitive primary explosive. The previous approach to achieve no-fire currents above a few hundred milliamps is to use a large diameter bridgewire and thermally conductive header dielectrics. This tends to extend function time for many applications and frequently becomes the unacceptable limit. Thus, there is a need for hermetic header designs which permit high no-fire currents in combination with very fast function times for reasonable firing currents representative of traditional hot-wire EEDs. Ideally, a new device capable of no-fire currents above one amp at one watt with function times of approximately one microsecond at current levels of twenty amps is desired. None of the previous detonators in either group satisfy these requirements.

SUMMARY OF THE INVENTION

The present invention uses a metal-to-glass-to-metal header as a base support. This metal-to-glass-to-metal header amounts to having a metal pin within a glass tube within a metal sleeve. The pin part of the header is connected to a conductive material such as gold mesh which in turn is electrically connected to a resistive film. Because of the circular symmetry of the metal-to-glass-to-metal header the resistive film can form a ring connected through the middle by the conductive pad to the metal pin. The resistor film is mounted on a silicon chip. The appropriate metal bridge is connected to the metal sleeve of the header. When a power supply is connected across the metal sleeve and metal pin a current path is formed which passes through the silicon chip with its resistor film. Because of the circular symmetry the complete resistive film ring is permitted to heat providing a large surface area for the primary explosive to be packed against. The large surface in effect permits spurious low level currents to generate heat which is absorbed by the silicon chip and the primary explosive over a relatively diffuse area. Thus, typical low level currents will generate far less heat per volume into the primary explosive than in previous models. By the same token, when sufficient heat due to a high enough current is produced in the resistor film a much larger surface area of primary explosive is receiving this heat thus producing more reliability in the triggering of the detonation.

BRIEF DESCRIPTION OF THE DRAWING

The FIGURE is a cutaway section of a side view of the present invention.

DESCRIPTION OF THE PREFERRED EMBODIMENT

The FIGURE shows the present invention in side view with a header 10. Header 10 is comprised of a pin 12, a ring 14, which can be considered a glass tube surrounding pin 12, and a sleeve 16 which in turn surrounds ring 14. Ring 14 serves as an insulator between pin 12 and sleeve 16. Surrounding sleeve 16 is a ring 18. Ring 18 forms a cup to hold explosive. Ring 18 and sleeve 16 can be made of stainless steel or other highly conductive metal combinations. Current in lead 20 is provided by a power source 22 which in turn is connected to pin 12. Power source 22 can be a battery or other source of electrical current. Obviously a current will flow whenever a conductive path is present between sleeve 16 and pin 12.

A solid state bridge is connected between sleeve 16 and pin 12 via a silicon chip 24 which has a thickness determined by mechanical, thermal, and electrical constraints. Chip 24 may be made of various materials other than silicon which will readily conduct an electric current. Chip 24 may be doped to provide desired semiconductor current limitations. Chip 24 is usually doped for high conductivity level and low resistance. Deposited around chip 24 is an insulating layer 26, such as $SiO_2$. Header 10 is polished prior to attaching chip 24. As shown in the FIGURE, the layer's thickness as compared to the thickness of the chip itself are not drawn to scale. Holding silicon chip 24 to sleeve 16 is a conducting material 28 which can also contact ring 18 as shown. Conductive material 28 can be a gold glass frit or thick gold film which transmits electrical current from metal sleeve 16. To isolate the electrical path, an insulating ring 30, which can also be silicon dioxide, $SiO_2$, serves as an insulating coating on silicon chip 24 similar to insulating layer 26. Current passes from conductive material 28 through silicon chip 24 to a resistor film bridge 32 which can be a chromium-silicon, CrSi, composite material or some other appropriate resistor material. Current passes through this resistor film but due to the increased resistance inherent in the material a heating effect is caused throughout resistor film bridge 32.

Insulating layer 26 and insulating ring 30 may be deposited as a single coating with openings etched in each side of the $SiO_2$.

Resistor film bridge 32 is connected to a conductive cap 34 via a metallurgical joint 36. Conductive cap 34 may be a gold mesh and metallurgical joint 36 can be a solid gold pad. A protective layer 38, such as silicon dioxide, $SiO_2$, or other material that is corrosion resistant, is placed over resistor film 32. Protective layer 38 also serves as a conducting layer for heat generated in resistor film 32. Protective layer 38 provides corrosion protection because it is inert and prevents the explosive from reacting with a metal surface. Primary explosive 40 is packed within ring 18 on top of protective layer 38 and conductive cap 34 to fill in the top of this detonator.

Because of the circular symmetry involved, resistor film bridge 32 is an annular ring. The large amount of surface area permits relatively low currents to dissipate their heat over a wide surface area producing very little heat absorption by primary explosive 40 per unit volume. Primary explosive 40 may be lead azide or some other suitable compound. Thus, the low current problem of earlier thermal detonators is avoided due to the large increase in surface area which permits the actual heat caused by the spurious current to be dissipated due to its thermal dissipation characteristics. However, when the normal detonating current is present in resistor film bridge 32, adequate heat is generated such that a large detonating surface area in primary explosive 40 is created which is a far greater working surface area than anything previously used in a thermal initiated detonator. As a result of this, far more energy is transferred with a greater efficiency which permits significantly reduced reaction times.

Conductive cap 34 is electrically connected to pin 12 via a frit filled hole 42 which permits electrical contact between connective cap 34 and pin 12. A seal 44, which can be a glass frit, is placed across ring 14 to assure a mechanical support, a thermal path, and an insulating boundary between sleeve 16 and pin 12 except for a current path which goes through silicon chip 24, resistor film bridge 32, metallurgical joint 36 and conductive cap 34. Thus, a series electrical circuit is formed by power source 22, sleeve 16, conductive material 28, chip 24, resistor film bridge 32, pads 36 and cap 34, and pin 12. A switch, not shown, to be closed at a predetermined time for the circuit to be active, is added in series with power source 22 and sleeve 16.

This invention replaces the wire bridge of traditional EEDs with a deposited metallic film bridge. Unlike other film bridge detonators, there is no requirement for extremely fine polishing of the header surface. This is due to the film not being deposited directly on the header. Construction techniques made feasible by the use of silicon substrate also permit a major advantage in this invention. It can be readily arranged that the metallic bridge be thermally clamped to the header structure in a way very advantageous to conduct heat generated by inadvertent currents away from the primary explosive. By interposing between the bridge and the substrate a very thin film of much less thermally conductive silicon dioxide, no more than a negligible fraction of the heat from an intended firing pulse will be conducted away into the header before ignition occurs. Yet when considering the lower levels and much longer time duration of an inadvertent or stray current, after the first few microseconds of application, the thin insulating film will not present a barrier to conducting the generated heat away from the header. Most of this heat due to stray currents is conducted away via the thin film into the chip and then into the leads. Thus, lower energy density is conducted safely away while higher energy densities cause ignition.

Among the several advantages of this invention are the very fast function times attainable with moderate firing energies while still able to absorb unusually large stray currents without firing. Ease in production due to uniform resistance of bridges and improved hermetic seal permit use of modern solid state technology for most critical features.

It is obvious to those skilled in the art that modifications to the above device can be made.

What is claimed is:

1. A solid state detonator comprising:

a header having first and second electrical conductors and an insulating layer, said insulating layer separating said conductors;

a chip in electrical contact with said first electrical conductor of said header;

a film bridge defining an electrical path area electrically connected to said chip;

at least one electrical conducting pad electrically connected in series between said film bridge and said second electrical conductor of said header;

at least one insulating layer electrically shielding said chip, said insulating layer interposed between said film bridge and said chip such that no more than a negligible fraction of heat caused by a firing pulse will be conducted away via said chip before ignition occurs, yet the lower energy density levels of inadvertent or stray currents will conduct heat away through said insulating layer and into said chip after a few microseconds of application;

a power source connected to said first and second electrical conductors of said header;

a protecting layer covering said film bridge; and primary explosive contacting said protective layer and separated from said film bridge by said protective layer.

2. A solid state detonator as described in claim 1 where said chip comprises a silicon chip.

3. A solid state detonator as described in claim 1 where said protective layer comprises a silicon dioxide, $SiO_2$, surface.

4. A solid state detonator as described in claim 1 where said film bridge comprises a CrSi resistor film.

5. A solid state detonator as described in claim 1 where said electrical conducting pads comprise gold mesh.

6. A solid state detonator as described in claim 1 further comprising at least one electrical insulating layer electrically shielding said chip.

7. A solid state detonator comprising:

a header having a pin, a sleeve and an insulating layer, said insulating layer separating said pin and sleeve;

a silicon chip in electrical contact with said sleeve;

a CrSi film bridge defining an electrical path area electrically connected to said silicon chip;

at least one gold mesh electrical conducting pad electrically connected in series between said CrSi film bridge and said pin;

at least one $SiO_2$ insulating layer electrically shielding said silicon chip, said insulating layer interposed between said film bridge and said chip such that no more than a negligible fraction of heat caused by a firing pulse will be conducted away via said chip before ignition occurs, yet the lower energy density levels of inadvertent or stray currents will conduct heat away through said insulating layer and into said chip after a few microseconds of application;

a power source connected to said pin and sleeve of said header;

an $SiO_2$ protective layer covering said film bridge; and primary explosive covering said $SiO_2$ protective layer and separated from said CrSi film bridge by said $SiO_2$ protective layer.

* * * * *